United States Patent [19]

Savage et al.

[11] Patent Number: 4,762,553

[45] Date of Patent: Aug. 9, 1988

[54] METHOD FOR MAKING RAPIDLY SOLIDIFIED POWDER

[75] Inventors: Steven J. Savage, Farsta, Sweden; Daniel Eylon, Dayton, Ohio

[73] Assignee: The United States of America as represented by the Secretary of the Air Force, Washington, D.C.

[21] Appl. No.: 42,074

[22] Filed: Apr. 24, 1987

[51] Int. Cl.[4] ..... B22F 9/08

[52] U.S. Cl. ..... 75/0.5 C; 219/7.5; 264/10; 264/12; 425/6; 425/7; 425/10

[58] Field of Search ..... 75/0.5 C; 425/6, 7, 425/10; 264/12, 10; 219/7.5

[56] References Cited

U.S. PATENT DOCUMENTS

| | | | |
|---|---|---|---|
| 2,402,441 | 6/1946 | Paddle | 83/91 |
| 2,630,623 | 3/1953 | Chisholm et al. | 20/148 |
| 2,909,808 | 10/1959 | Frehn | 18/47.3 |
| 3,093,315 | 6/1963 | Tachiki et al. | 239/424 |
| 3,126,275 | 3/1964 | Tudja | 75/26 |
| 3,313,608 | 4/1967 | Guyer et al. | 264/10 |
| 4,124,377 | 11/1978 | Larson | 75/0.5 C |
| 4,304,594 | 12/1981 | Munck | 75/10 R |
| 4,353,408 | 10/1982 | Pryor | 164/503 |
| 4,469,508 | 9/1984 | Amouroux et al. | 75/10 R |

FOREIGN PATENT DOCUMENTS 1499809 2/1978 United Kingdom .

*Primary Examiner*—Wayland Stallard

*Attorney, Agent, or Firm*—Bobby D. Scearce; Donald J. Singer

[57] ABSTRACT

System and method for producing metal or alloy powder are described comprising an electromagnetic levitating coil having an outlet for supporting a molten source of the metal or alloy and controllably discharging a molten stream thereof, an electromagnetic confining coil disposed at the outlet of the levitating coil and surrounding the molten stream for controlling the diameter of the molten stream, and either an atomization die and associated pressurized fluid source for disintergrating the confined molten stream into molten droplets for subsequent cooling to powder, or a controllable electromagnetic coil surrounding the confined molten stream for generating a downwardly and radially outwardly directed electromagnetic force interacting with the molten stream to form the droplets.

21 Claims, 1 Drawing Sheet

METHOD FOR MAKING RAPIDLY SOLIDIFIED POWDER

RIGHTS OF THE GOVERNMENT

The invention described herein may be manufactured and used by or for the Government of the United States for all governmental purposes without the payment of any royalty.

BACKGROUND OF THE INVENTION

The present invention relates generally to rapid solidification techniques for producing metallic powders, and more particularly to method and system for large scale production of contamination free powder of high melting temperature reactive and nonreactive metals and alloys.

In industrial applications of metal and alloy powders, spherical powders which flow well and have consistently high tap density are specially desirable in powder metallurgy processes for consolidation by way of vacuum hot pressing at high pressure to pressed parts with near net product shape. Metallic powders produced by rapid solidification of molten droplets of the constituent metal or alloy may generally have ultrafine grain structure and are therefore particularly desirable for finished pressed parts. Rapid solidification may also be used to supersaturate powder of a metal host with a selected alloying constituent which upon heat treatment of a pressed part results in useful alloy phases not obtainable by conventional heat treatment methods. In the fabrication of powder from alloys useful in fabricating aerospace components, contaminants in the powder must be carefully controlled and excluded since even small contaminant levels may have substantial deleterious effects on metallurgical and physical properties of the pressed powder which may result in severe degradation or fatal defects in a finished component.

Conventional methods for producing metallic powder include chemical methods wherein powder is produced by chemical decomposition of a metal compound, mechanical methods wherein the metal form is mechanically comminuted to the desired particle size, and physical methods wherein a molten stream of the metal or alloy is atomized by impact with a fluid, usually gas, jet. Atomization processes are commonly used in the production of metallic powders, and are the most convenient for production of alloy powders of the type required for modern high temperature applications. Such an atomization process is generally a two step process comprising providing a melt of the metal or alloy, followed by disintegrating a molten stream of the melt into droplets by impact with one or more high pressure fluid streams. Powders in the size range of from about 0.1 to about 1000 microns may be produced. In the production of rapidly solidified metallic powder utilizing gas atomization techniques, small particles solidify faster and often into a different microstructure than large particles; accordingly, microstructural uniformity in a finished powder compact requires close control of particle size in limited size ranges. Atomization processes may be applicable to the production of powders of most metal and alloys of interest including iron, tin, nickel, copper, aluminum, titanium, tungsten, molybdenum, tantalum, niobium, magnesium and the alloys including stainless steels, bronze, brass and nickel/cobalt based superalloys. A comprehensive survey of conventional atomization techniques is presented in "Production of Rapidly Solidified Metals and Alloys", by S. J. Savage and F. H. Froes, J Metals 36:4, 20–33 (April 1984).

High purity powders of reactive and/or high melting point metals or alloys are difficult to produce utilizing presently known atomization processes, mainly because a shortcoming exists in those processes in that melting and pouring of molten metallic material in a controlled flow through the die or other atomization means using furnaces, crucibles, nozzles or other handling means contribute contaminants to the melt. Reactive and/or high melting melts rapidly erode process equipment resulting in abbreviated production runs, high maintenance costs and contamination of the powder product. Certain existing processes which do not use a nozzle to confine or to direct the melt (see, e.g., rotating electrode process and others described in Savage et al, supra) are incapable of producing powder in a desirably fine size range or at acceptable production rate.

The present invention provides system and method for producing substantially contamination free powder of reactive, nonreactive and high melting metals and alloys which comprises atomization of a molten stream directed from a melt suspended electromagnetically. In the method of the invention, electromagnetic induction means conventionally used for melting and levitation is combined uniquely with electromagnetic confinement means for controlling the shape and flow rate of a molten metal stream and an atomization process for disintegrating the stream into droplets for solidification into powder without direct contact of the melt, molten stream or molten droplets with the process equipment. Levitation melting in vacuum or inert gas without a conventional nozzle according to the invention substantially eliminates contamination of the molten stream. The method and system of the invention therefore provides large scale production of powder at solidification rates substantially higher than that of conventional processes. A wide alloying range for metallic powder product is achievable, and, compared to previously known systems, substantial savings in equipment maintenance cost is realized.

It is therefore a principal object of the invention to provide method and system for producing rapidly solidified metallic powder.

It is a further object of the invention to provide method and system for producing contamination free metallic powder.

It is another object of the invention to provide method and system for large scale production of metallic powder.

These and other objects of the invention will become apparent as the description of representative embodiments proceeds.

SUMMARY OF THE INVENTION

In accordance with the foregoing principles and objects of the invention, system and method for producing metal or alloy powder are described comprising an electromagnetic levitating coil having an outlet for supporting a molten source of the metal or alloy and controllably discharging a molten stream thereof, an electromagnetic confining coil disposed at the outlet of the levitating coil and surrounding the molten stream for controlling the diameter of the molten stream, and either an atomization die and associated pressurized fluid source for disintegrating the confined molten stream into molten droplets for subsequent cooling to powder or a controllable electromagnetic coil surrounding the confined molten stream for generating a downwardly and radially outwardly directed electromagnetic force interacting with the molten stream to form the droplets.

DESCRIPTION OF THE DRAWINGS

The invention will be fully understood from the following description of representative embodiments thereof read in conjunction with the accompanying drawings wherein.

DETAILED DESCRIPTION

Figure 1:
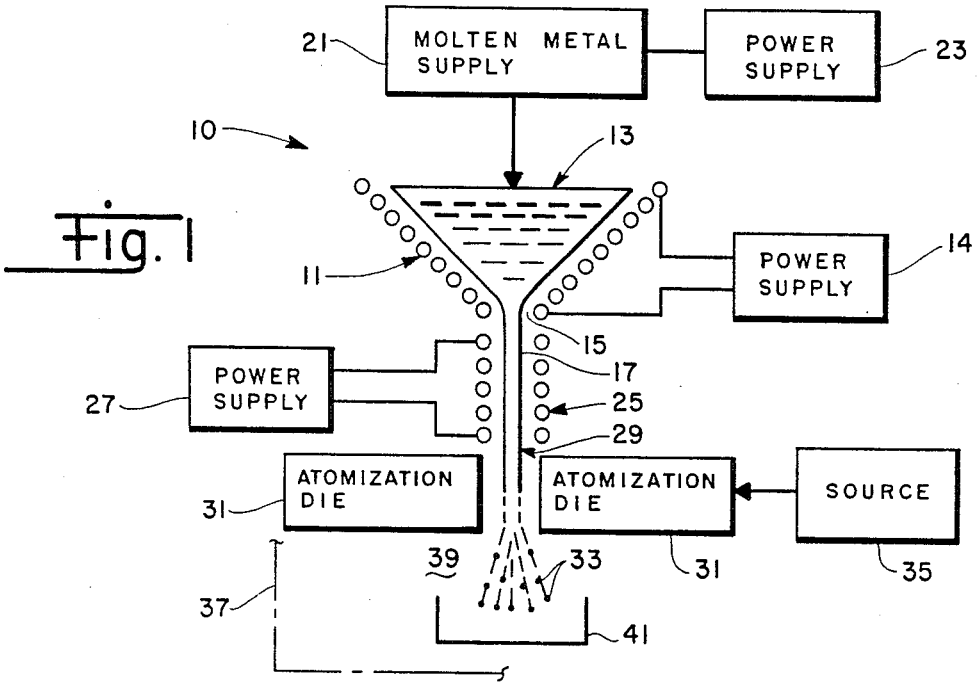
FIG. 1 is a schematic of a powder production system of the invention and which is useful in practicing the method thereof.

Referring now to the drawings, FIG. 1 is a schematic of a representative powder production system 10 of the invention. System 10 includes levitating means in the form of first levitating coil 11 having generally funnel shaped configuration for supporting molten pool 13 of metal or alloy and connected to an appropriately sized controllable power supply 14. It is understood that the invention described herein may be applied to production of metallic powder from a wide range of metals and alloys, and therefore, as used herein, the words "metal" or "metallic" are construed to describe and to include reference to both metals and alloys.

Levitating coil 11 includes an opening 15 in the lower portion thereof for defining a gravity fed molten metallic stream 17 of preselected size and flow rate to be atomized according to the method of the invention. The levitation means is conventional and similar to that described in U.S. Pat. No. 4,353,408. Coil 11 may comprise electromagnetic means both for generating heat to melt metallic material and form pool 13 and for providing sufficient levitating forces to support pool 13.

Figure 2:
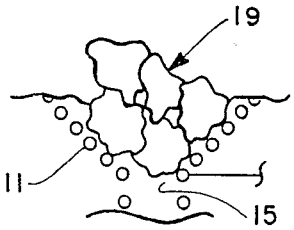
FIG. 2 is a fragmentary view of a portion of the system of FIG. 1 showing metallic material loaded into the levitating coil.

Referring now additionally to FIG. 2, a charge 19 of metallic material in pellet, granular, ingot or other form may be placed within coil 11 and heated and levitated simultaneously with sufficient energy to fuse the material to pool 13. Alternatively, molten metal may be poured into and levitated by activated coil 11 from a separate furnace comprising molten metal supply 21 fused using controllable power supply 23. Molten metal supply 21 may comprise substantially any conventional melting process such as induction, electron beam, tungsten arc, plasma or laser heating in air, inert gas or vacuum. However, to avoid contamination problems associated with contact of the melt with a crucible or nozzle, and otherwise to ensure purity of stream 17, supply 21, if used, may comprise skull melting of the selected metallic material combined with edge pour as a preferred scheme.

A second confining coil 25 of preselected diameter, length and power, and connected to a controllable power supply 27, is disposed below opening 15 of coil 11 for axially receiving stream 17 therethrough from coil 11 and for confining stream 17 in a substantially cylindrical column 29. Suitable control of power applied to coil 25 permits column 29 diameter to be controlled according to preselected stream 17 size and flow rate for atomization. The confining process associated with control of column 29 size and stream 17 flow rate is similar to that used for production of continuous, elongated pieces or components, by continuously cooling and solidifying column 29 as formed. In the practice of the method of the invention, however, stream 17 is maintained in the molten state at sufficiently high temperature through suitable control of power applied to coil 25 to prevent incipient solidification or crystallization of column 29.

Suitable atomizing means, such as shown in the representative embodiment of FIG. 1 as atomization die 31, is disposed below coil 25 to disintegrate molten column 29 into tiny droplets 33 for subsequent cooling to powder product. In a preferred embodiment, die 31 is a gas atomization die which is connected to source 35 of pressurized gas. In the gas atomization process, stream 17 is impacted by one or more high velocity gas jets which disintegrate the molten metal into individual droplets 33. The atomization process may be performed within a chamber 37 (shown schematically by peripheral broken line) containing medium 39 such as air, inert gas or vacuum, for cooling droplets 33 to preserve high purity of the powder product during solidification of droplets 33. Powders produced in the process may range in size from about 0.1 to 1000 microns; accordingly, droplets 33 solidify rapidly after formation by passage through medium 39, and may be received by a collector container 41 for subsequent size classification and use.

Any of a plurality of conventional atomization processes may be used in conjunction with system 10, as would occur to one with skill in the field of the invention guided by these teachings, many of which are described in Savage et al, supra, depending upon the desired form, shape, size, surface condition, and other powder product specifications, and source 35 may correspondingly comprise nitrogen, argon, helium, methane, carbon dioxide, hydrogen or other gaseous or liquid material conventionally used in fluid atomization processes, the same not being limiting of the invention herein.

Figure 3:
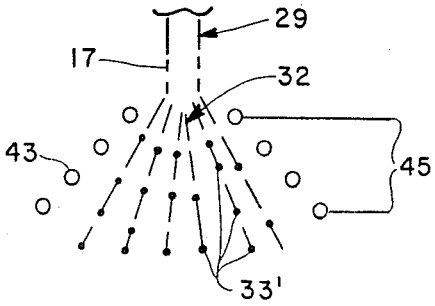
FIG. 3 is a fragmentary view of a portion of the FIG. 1 system showing an alternative embodiment of the invention.

In accordance with a further embodiment of the invention, and referring additionally to FIG. 3, a third accelerating induction coil 43 connected to a controllable power source 45 may be disposed coaxially around the lower end of column 29 to replace atomization die 31 in the disintegration of stream 17 into a dispersed stream 32 of droplets 33'. Coil 43 is generally conical in shape as suggested in FIG. 3 and energized to generate a downwardly and radially outwardly directed electromagnetic accelerative force (in direction opposite to the levitating force generated by coil 11), which force interacts with stream 17 and atomizes it into droplets 33'. The atomization process represented in FIG. 3 combined with the levitating and column confining configuration of FIG. 1 has particular utility for atomizing reactive metals and alloys, since the entire process may be performed inside chamber 37 under vacuum. It is noted, however, that the atomization means of FIG. 3 embodied in coil 43 may be used in conjunction with alternative arrangements for forming a molten stream other than that suggested in FIG. 1, the combination of equipment of FIGS. 1 and 3 therefore not being limiting of the invention described and claimed herein.

In the practice of the invention, pool 13 (supplied from supply 21 or melted within coil 11) may comprise substantially any metal or alloy including as a nonlimiting representative group, iron, cobalt, nickel, aluminum, hafnium, zinc, titanium, niobium, zirconium, tin, copper, tungsten, molybdenum, tantalum, and magnesium, and stainless steels, bronze, brass, lithium alloys and nickel/cobalt based superalloys, to which the invention may be applied by one with skill in the field of the invention guided by these teachings. Suitable coil 11 design and control of the electromagnetic field generated thereby results in molten metallic material being levitated out of contact with the process equipment to prevent contamination and reaction of the melt. Proper control of levitating coil 11 and confining coil 25 regulates stream 17 to preselected flow rate substantially equivalent to that of a solid nozzle. A levitating coil of the type depicted in FIG. 1 may be sized to support a charge 19 of metallic material of about 2 kg in batch or continuous feed operation, and render powder product at a production rate of up to about 200 kg per day. In any embodiment of the invention described herein, controllable cooling rates for powder product in a desirable range of from about $10^2$ to about $10^7$ centigrade degrees per second are readily attainable.

The invention therefore provides a novel rapid solidification system and method for producing metallic powders. It is understood that modifications to the invention as described may be made, as might occur to one with skill in the field of the invention, within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A method for producing powder of metal or alloy material comprising the steps of:

(a) providing a source of molten said material;

(b) electromagnetically levitating said molten said material, on a levitating coil having an outlet, and forming a molten stream of said material directed from said outlet of said levitating coil;

(c) electromagnetically confining said molten stream to preselected stream diameter;

(d) disintegrating the confined said moltens stream into droplets of molten said material; and (e) cooling said droplets to form said powder.

2. The method of claim 1 wherein said disintegrating step includes impacting said molten stream with a fluid stream in an atomization die.

3. The method of claim 1 wherein said disintegrating step includes directing said molten stream through a controllable electromagnetic coil generating a downwardly and radially outwardly directed electromagnetic force interacting with said molten stream and thereby disintegrating said molten stream.

4. The method of claim 1 wherein said material comprises a metal selected from the group consisting of iron, cobalt, nickel, aluminum, hafnium, zinc, titanium, niobium, zirconium, tin, copper, tungsten, molybdenum, tantalum, and magnesium.

5. The method of claim 1 wherein said material comprises an alloy selected from the group consisting of titanium-aluminum, magnesium-lithium, nickel-aluminum, molybdenum-titanium, tungsten-hafnium, stainless steel, bronze, brass, and nickel/cobalt based superalloys.

6. The method of claim 2 wherein said fluid is a material selected from the group consisting of nitrogen, argon, helium, methane, carbon dioxide, and hydrogen.

7. A method for producing powder of metal or alloy material comprising the steps of:

(a) forming a molten stream of said material;

(b) electromagnetically confining said molten stream and controlling the diameter of said molten stream; and (c) disintegrating said molten stream into droplets of molten said material for subsequent cooling to said powder.

8. The method of claim 7 wherein said disintegrating step includes impacting said molten stream with a fluid stream in an atomization die.

9. The method of claim 7 wherein said disintegrating step includes directing said molten stream through a controllable electromagnetic coil generating a downwardly and radially outwardly directed electromagnetic force interacting with said molten stream and thereby disintegrating said molten stream.

10. The method of claim 7 wherein said material comprises a metal selected from the group consisting of iron, cobalt, nickel, aluminum, hafnium, zinc, titanium, niobium, zirconium, tin, copper, tungsten, molybdenum, tantalum, and magnesium.

11. The method of claim 7 wherein said material comprises an alloy selected from the group consisting of titanium-aluminum, magnesium-lithium, nickel-aluminum, molybdenum-titanium, tungsten-hafnium, stainless steel, bronze, brass, and nickel/cobalt based superalloys.

12. The method of claim 8 wherein said fluid is a material selected from the group consisting of nitrogen, argon, helium, methane, carbon dioxide, and hydrogen.

13. A system for producing powder of metal or alloy material comprising:

(a) a source of molten said material;

(b) electromagnetic levitating means for supporting said molten said material, said levitating means including an outlet for discharging from said levitating means a molten stream of said material;

(c) electromagnetic confining means disposed at said outlet of said levitating means and surrounding said molten stream for controlling the diameter of said molten stream, said confining means including an inlet and an outlet for conducting said molten stream therethrough; and (d) atomization means disposed near said molten stream and adjacent said outlet of said confining means for disintegrating said molten stream into droplets of molten said material for subsequent cooling to said powder.

14. The system of claim 13 wherein said atomization means comprises a source of pressurized fluid and an atomization die disposed adjacent said outlet of said confining means and operatively connected to said source of pressurized fluid for directing a fluid stream against said molten stream.

15. The system of claim 13 wherein said atomization means comprises a controllable electromagnetic coil disposed near the outlet of said confining means and surrounding said molten stream and generating a downwardly and radially outwardly directed electromagnetic force for interaction with said molten stream and disintegration of said molten stream thereby.

16. A system for producing powder of metal or alloy material comprising:

(a) an electromagnetic levitating first coil for melting said material and supporting molten said material, said first coil including an outlet for discharging from said first coil a molten stream of said material;

(b) an electromagnetic confining second coil disposed at said outlet of said first coil and surrounding said molten stream for controlling the diameter of said molten stream, said second coil including an inlet and an outlet for conducting said molten stream therethrough; and (c) atomization means disposed near said molten stream and adjacent said outlet of said second coil for disintegrating said molten stream into droplets of molten said material for subsequent cooling to said powder.

17. The system of claim 16 wherein said atomization means comprises a source of pressurized fluid and an atomization die disposed adjacent said outlet of said second coil and operatively connected to said source of pressurized fluid for directing a fluid stream against said molten stream.

18. The system of claim 16 wherein said atomization means comprises a controllable electromagnetic third coil disposed near the outlet of said second coil and surrounding said molten stream and generating a downwardly and radially outwardly directed electromagnetic force for interaction with said molten stream and disintegration of said molten stream thereby.

19. A system for producing powder of metal or alloy material comprising:

(a) means for forming a molten stream of said material;

(b) an electromagnetic confining first coil disposed for surrounding said molten stream and controlling the diameter of said molten stream, said first coil including an inlet and an outlet for conducting said molten stream therethrough; and (c) atomization means disposed near said molten stream and adjacent said outlet of said first coil for disintegrating said molten stream into droplets of molten said material for subsequent cooling to said powder.

20. The system of claim 19 wherein said atomization means comprises a source of pressurized fluid and an atomization die disposed adjacent said outlet of said second coil and operatively connected to said source of pressurized fluid for directing a fluid stream against said molten stream.

21. The system of claim 19 wherein said atomization means comprises a controllable electromagnetic second coil disposed near the outlet of said first coil and surrounding said molten stream and generating a downwardly and radially outwardly directed electromagnetic force for interaction with said molten stream and disintegration of said molten stream thereby.

* * * * *